United States Patent [19]

Strong

[11] Patent Number: 4,770,217

[45] Date of Patent: Sep. 13, 1988

[54] WOOD CHIPPER WITH SEAL PROTECTOR

[76] Inventor: Donald E. Strong, 498 Eight Mile Rd., Remus, Mich. 49340

[21] Appl. No.: 122,026

[22] Filed: Nov. 18, 1987

[51] Int. Cl.[4] ..... B27C 1/00

[52] U.S. Cl. ..... 144/176; 241/92; 241/278 R

[58] Field of Search ..... 384/144, 488; 241/51, 241/74, 79, 92, 278 R, 32, 55; 144/162 R, 176

[56] References Cited

U.S. PATENT DOCUMENTS

| | | | |
|---|---|---|---|
| 1,295,388 | 2/1919 | Tidmarsh | 144/176 |
| 1,932,166 | 10/1933 | Sumner | 144/176 X |
| 3,000,411 | 9/1961 | Ealet | 144/176 |
| 3,866,843 | 2/1975 | Lunn | 241/278 R X |
| 4,635,862 | 1/1987 | West et al. | 241/51 |

*Primary Examiner*—W. Donald Bray

*Attorney, Agent, or Firm*—Varnum, Riddering, Schmidt & Howlett

[57] ABSTRACT

A wood chipper for chipping wood, such as logs, into particles, has a chipping block rotatably mounted in a housing on a shaft, which in turn is mounted to a housing through bearings. Seals protect the bearings from dirt and moisture. The seals on an inlet side of the chipper block are protected by a tubular collar mounted to and extending axially from the chipper block in concentric relationship with a portion of the housing in which the seals are mounted. The housing has a tubular portion which extends near to the chipper block and within the tubular collar to provide a tortuous path for dirt and debris. The seals are mounted within the tubular extension.

13 Claims, 2 Drawing Sheets

WOOD CHIPPER WITH SEAL PROTECTOR

BACKGROUND OF THE INVENTION

1. Field of the Invention

This invention relates to rotary wood chippers for reducing wood materials into chips and more particularly to an improved seal in such apparatus.

2. Description of the Prior Art

In tree trimming or removal operations, limbs and other scrap wood material must be disposed of, which in the past has been accomplished by burning the scrap wood. In populated areas, such burning increases the pollution content of the air which is undesirable. Recently, the scraps have been reduced to wood chips which can then be employed for paper manufacture or, in some cases, used as a mulch around shrubs and the like. It is not generally feasible, however, to truck the wood scraps to a mill for processing in wood chippers since the expense of the gathering and shipping frequently outweighs the value of the resulting wood chips.

Some wood chippers have been designed which are portable and which are capable of processing at least small branches into wood chips which then can be gathered at the site of the tree trimming operation or can be distributed on the ground whereupon the chips will decay naturally without causing environmental pollution. Some existing portable wood chippers, however, are generally not capable of handling relatively large limbs or medium sized trees (i.e., with diameters up to 15 inches). This problem is due to the relatively lightweight construction of the trailer-hauled portable wood chippers which are designed primarily for very small branches and not general duty purposes. On the other hand, existing wood chippers which are designed for larger pieces of wood material are extremely heavy and cannot easily be transported; or in cases where heavy duty chippers have been mounted on large trailers, the cost of the unit is prohibitive for small operators. Thus, there existed a need for a relatively heavy duty and yet portable chipper unit which was not overly costly.

U.S. Pat. No. 3,844,489 disclosed on improved wood chipper comprising a generally rectangular chipping block having at least one aperture extending through the block and a chipper knife positioned on the edge of the aperture. Positioned on flat top and bottom edges of the rectangular block are chip clearing fan blades. The chipping block is enclosed and rotatably mounted in a housing which has an input aperture on one face for receiving material to be chipped and a discharge chute extending tangentially from the periphery thereof for removal of wood chips. The housing is mounted on a suitable framework at an acute angle relative to the direction of feed such that the chipper knife tends to draw the material into the chipper. Rotation of the chipping block is facilitated by a rotary shaft mounted between a pair of bearing block assemblies bolted to the outside of the housing. The bearing assemblies are of conventional design.

A considerable amount of air is generated inside the housing to discharge the wood chips. Because the housing together with the shaft is at an acute angle to a horizontal plane and due to the air currents which pull the chips from the housing, the upper bearing assembly is kept relatively free from dirt and other contaminants. However, the lower bearing assembly tends to accumulate dirt such that the seals can fail and thereby expose the lower bearings to contamination. Consequently, the lower bearings tend to fail prematurely.

SUMMARY OF THE INVENTION

According to the invention, a wood-chipping apparatus has a means to protect the shaft seals from dirt and debris. The wood-chipping apparatus comprises a housing having an inlet opening for feeding wood into the housing and an outlet opening for discharging wood particles from the housing. A chipper block is mounted on a shaft in the housing for chipping wood fed through the housing. Bearings mount the shaft in the housing for rotation about a longitudinal axis. Seals are provided between the housing and the shaft to protect the bearings from dirt and moisture. According to the invention, a tubular collar is mounted to and extends axially from the chipper block in concentric relationship with a portion of the housing to deflect dirt and moisture from the seals. Preferably, the seals are mounted in the housing portion which is tubular and extends near to the chipper block. Further, the seals are mounted near to the chipper block.

The invention is principally directed to those seals at an in-feed side of the chipper block. Thus, the seal, housing portion and tubular collar are positioned at an in-feed side of the chipper block.

Typically, the chipping apparatus to which the invention relates has a fan mounted to an outlet side of the chipper block to propel wood particles through the outlet opening of the housing. Further, the shaft is mounted at an acute angle to the horizontal with an in-feed end thereof being lower than an outlet end thereof. Thus, the protected seals are at an in-feed side of the chipper block and are at a lower end than any seals and bearings provided at an outlet end of the housing.

The invention thus provides a structure for deflecting and minimizing the passage of dirt and moisture from the seal area between the chipper block and the bearings on an in-feed side of the housing.

BRIEF DESCRIPTION OF THE DRAWINGS

The invention will now be described with reference to the accompanying drawings in which.

DETAILED DESCRIPTION OF THE PREFERRED EMBODIMENT

Figure 1:
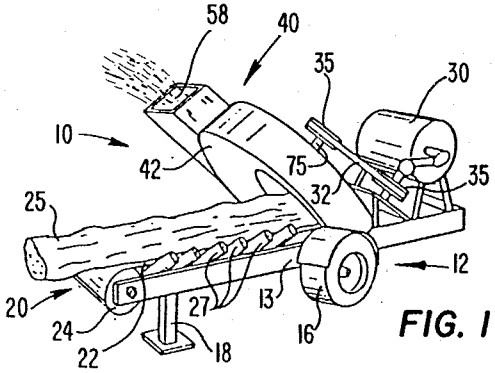
FIG. 1 is a perspective view showing a portable wood chipping apparatus mounted on a trailer and including an in-feed conveyor for use therewith.

Referring now to FIG. 1, there is shown a portable wood chipping apparatus 10 comprising a trailer 12 having a frame 13 mounted on an axle 14 with a pair of wheels 16. Suitable hitch means (not shown) are provided for coupling the trailer to a towing vehicle to transport the wood chipper. The trailer includes a retractable stand 18 which can be lowered to support the trailer such that the towing vehicle can be removed if desired when the chipper apparatus is in use. The wood chipping apparatus further includes feed means 20 such as a belt conveyor 22 which is supported between a pair of rollers 24 (one shown in the figure) to transport a log 25, branches, or other wood material into the chipping apparatus. A plurality of angled guide rollers 27 are positioned on either side of the belt conveyor 22 to provide guidance for the movement of the log 25 into the chipper 40. The conveyor can be driven by suitable conventional drive means (not shown). In some embodiments, the powered conveyor will be unnecessary and a trough can be employed for manually feeding material to the chipper.

Positioned at the output end of the conveyor 22 is the wood chipper 40 which comprises a chipper housing 42 which encloses the rotating portions of the wood chipper 40 and provides controlled discharge of the wood chips from a discharge chute 58. A power drive means 30 such as a gasoline or diesel powered engine is positioned to be coupled to a drive shaft 75 of the wood chipper 40. The coupling mechanism can be a pulley 35 and belt 32 as shown in FIG. 1 or any suitable gearbox.

Figure 2:
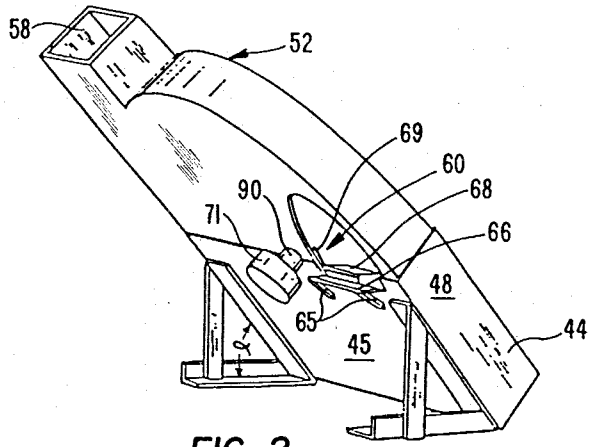
FIG. 2 is an enlarged perspective view of the chipping apparatus prior to mounting on the trailer.
Figure 4:
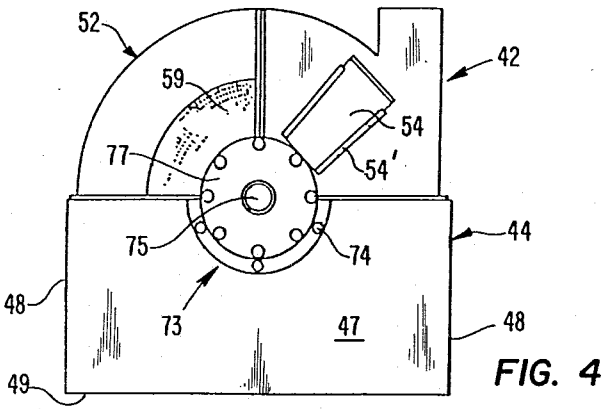
FIG. 4 is a rear elevational view of the housing.
Figure 3:
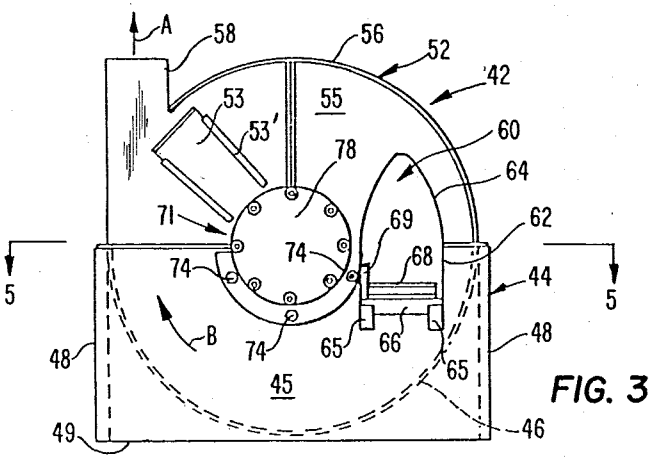
FIG. 3 is a front elevational view of the chipper housing.

Referring now to FIGS. 2 through 4, it is seen that the chipper housing 42 includes a rectangular base 44 having front and rear surfaces 45 and 47, respectively, joined by side walls 48 and a bottom panel 49. Brackets 43, suitably attached to the base 44, are employed to mount the housing on trailer 12 at an acute angle (FIG. 2) of approximately 37° to the direction of feed of material into the chipper. Within the rectangular base is mounted a semicircular plate 46 which prevents the corners of the base from being clogged with wood chips during operation of the rotary chipper.

The chipper housing 42 includes an upper portion 52 which is securely attached to the base 44 by suitable fastening means and which includes front and rear semicircular plates 55 and 57, respectively. A curved side wall 56 joins the front and rear plates and a rectangular discharge chute 58 extends tangentially from one side of the upper portion of the housing as shown in the figures. The front plate includes a slide plate 53 mounted within guide brackets 53' to provide access to the chipper block for knife replacement. The rear plate likewise includes a similar sliding plate 54 with guide means 54'. A screened air inlet 59 is provided in plate 57 to permit the entry of air which is circulated by the chipper and aids in exhausting chips from the discharge chute 58 in a direction indicated by the arrow A in FIG. 3. The direction of rotation of the chipper knives is indicated by arrow B in FIG. 3.

As shown in FIGS. 2 and 3, a material feed opening 60 is provided in the front surfaces of sections 52 and 44 and includes a rectangular bottom segment 62 formed in the base member 44, and a curved top portion 64 in the top section 52 of the chipper housing 42. A support plate 66 extends outwardly from the bottom edge of aperture 60 and is supported by suitable brackets 65 extending between the bottom surface of the plate and the front of the base. Positioned on the support plate 66 is a horizontal anvil 68 which has hardened wear surfaces over which the log 25 rides as it is being fed into the chipper.

Mounted on the interior of base member 44 at an inward edge of aperture 60 and extending vertically upward from horizontal anvil 68 is a vertical anvil 69. The vertical anvil 69 is removably mounted by the use of bolts 74 threaded through the chipper housing 42 into the vertical anvil 69. The vertical anvil 69 also has hardened wear surfaces against which the material abuts as the material is fed into the chipper.

Figure 5:
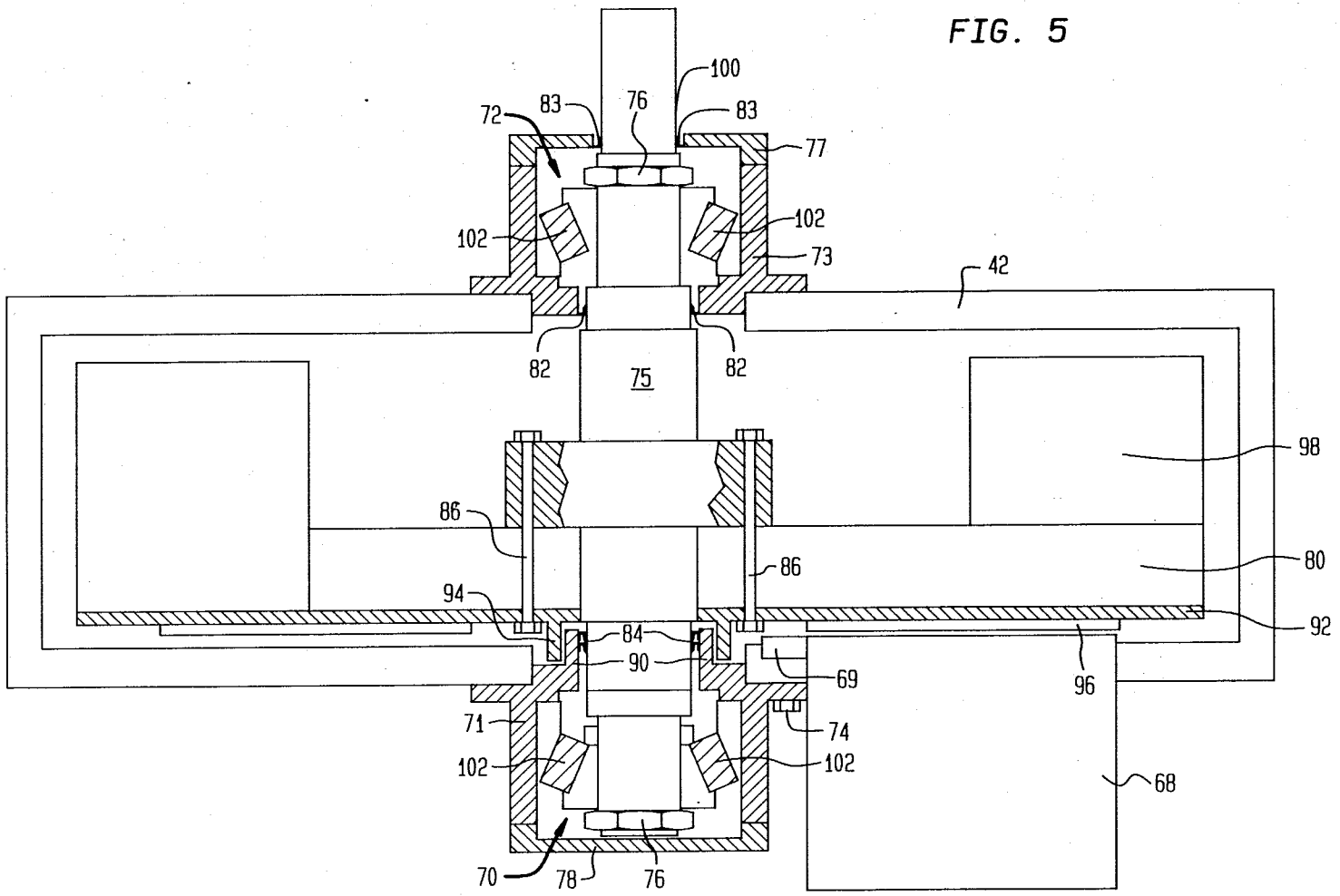
FIG. 5 is a cross-sectional view of the chipper taken along the lines 5—5 of FIG. 3.

Mounted centrally to the base 44 on opposite sides thereof are a lower bearing assembly 70 and an upper bearing assembly 72 that are bolted to the chipper housing 42 by means of a lower bearing housing 71 and an upper bearing housing 73 and suitable bolts 74 and which, as seen in FIGS. 4 and 5, support the rotary shaft 75 for the chipper.

As shown further in FIG. 5, the bearing assemblies comprise conventional tapered roller bearings 102 of the type made by Timken Corporation, and are each secured around the shaft 75 by means of a lock nut 76. An upper bearing seal 82 is interposed between the rotary shaft 75 and an interior portion of the upper bearing housing 73. An upper bearing cap 77 having a central aperture 100 through which the shaft 75 extends is bolted to the upper bearing housing 73 to completely enclose the upper bearing assembly 72. A seal 83 for the upper bearing cap 77 surrounds the shaft 75 to protect the upper bearing assembly 72. The lower bearing housing 71 has a portion 90 extending axially along the shaft 75 to the interior of the chipper housing 42 near the chipper block 80. There, interposed between the rotary shaft 75 and the extension 90 of the lower bearing housing is a lower bearing seal 84. A lower bearing cap 78 mounts to the exterior portion of the lower bearing housing 71 to completely enclose the lower bearing assembly 70.

A chipper block 80 of the type described in U.S. Pat. No. 3,844,489, the disclosure of which is incorporated herein by reference, is mounted to the shaft by bolts 86. The bolts 86 also mount a circular wear plate 92 to the chipper block 80. A tubular collar 94 of a diameter slightly greater than the diameter of the extension 90 of the lower bearing housing is mounted, preferably by welding, centrally to the wear plate 92 to form a shield around the lower bearing housing extension 90. Suitable knife assemblies 96, of a type, for example, described in U.S. Pat. No. 3,844,489, are affixed to the chipper block 80 and extend through slots in the wear plate 92.

Fan blades 98 are mounted to the chipper block 80 and extend rearwardly therefrom. Mounted as shown in FIG. 5, the fan blades 98 effectively draw air through intake 59 and exhaust air through chute 58 as the chipper block rotates. The wood chips, which pass through the slots in the wear plate 92 and chipper block 80, are carried by the air stream or physically thrown by the blades to be discharged from the chipper housing. In operation, the sharpened edges of the knife assemblies 96 rotating with the wear plate 92 and chipper block 80 contact the end of log 25 resting against the horizontal and vertical anvils 68, 69 and cut the log into chips which are then forced, partly by the knives, partly by their momentum and partly by the air flow created by the fan blades through the chipper block 80. In addition to providing a current of air to exhaust the chips, the fan blades physically contact the chips and tend to throw them out of the exhaust chute.

Because the shaft is at an angle of approximately 37° from the vertical, some dirt and debris from the chipping operation tends to fall toward the lower bearing housing 71. The tubular collar 94 rotating around the extension 90 of the lower bearing housing 71 shields the lower bearing seal 84 and deflects dirt and debris, thus preserving the seal and prolonging the life of the lower bearing assembly 70. The combination of the extension 90 and the depending tubular collar 94 provides a very effective protector for the seal and the lower bearing assembly 70.

Reasonable variation and modification are possible within the spirit of the foregoing specification and drawings without departing from the scope of the invention which is defined in the accompanying claim.

The embodiments of the invention in which an exclusive property or privilege is claimed are defined as follows:

1. In a wood-chipping apparatus comprising:

a housing having an inlet opening for feeding wood into said housing and an outlet opening for discharging wood particles from said housing;

a chipper block within said housing for chipping logs fed through said inlet opening;

a shaft mounting said chipper block for rotation about the longitudinal axis;

bearing means mounting said shaft in said housing for rotation about said longitudinal axis;

a seal between said housing and said shaft to protect said bearings from dirt and moisture;

the improvement which comprises:

a tubular portion of said housing surrounding said shaft; and a tubular collar mounted to and extending axially from said chipper block in concentric relationship with said tubular portion of said housing to deflect dirt and moisture from said seal.

2. A wood-chipping apparatus according to claim 1 wherein said seal is mounted in said housing portion.

3. A wood-chipping apparatus according to claim 2 wherein said housing portion extends near to said chipper block.

4. A wood-chipping apparatus according to claim 3 wherein said seal is mounted in said tubular housing portion near to said chipper block.

5. A wood-chipping apparatus according to claim 4 wherein said seal, tubular housing portion and tubular collar are positioned on an in-feed side of said chipper block.

6. A wood-chipping apparatus according to claim 5 and further comprising fan means mounted to an outlet side of said chipping block to propel wood particles through said outlet opening of said housing.

7. A wood-chipping apparatus according to claim 6 wherein said shaft is mounted at an acute angle to a horizontal plane with an in-feed end thereof being lower than an outlet end thereof.

8. A wood-chipping apparatus according to claim 5 wherein said shaft is mounted at an acute angle to a horizontal plane with an in-feed end thereof being lower than an outlet end thereof.

9. A wood-chipping apparatus according to claim 3 wherein said shaft is mounted at an acute angle to a horizontal plan with an in-feed end thereof being lower than an outlet end thereof.

10. A wood-chipping apparatus according to claim 1 wherein said seal, tubular housing portion and tubular collar are positioned on an in-feed side of said chipper block.

11. A wood-chipping apparatus according to claim 1 wherein said tubular housing portion is tubular and extends near to said chipper block.

12. A wood-chipping apparatus according to claim 11 wherein said seal, tubular housing portion and tubular collar are positioned on an in-feed side of said chipper block.

13. A wood-chipping apparatus according to claim 12 wherein said shaft is mounted at an acute angle to a horizontal plane with an in-feed end thereof being lower than an outlet end thereof.

* * * * *